United States Patent [19]

Saarinen

[11] Patent Number: 4,750,347

[45] Date of Patent: Jun. 14, 1988

[54] RIVETING APPARATUS

[76] Inventor: Tuomo Saarinen, SF-27860 Vuori, Finland

[21] Appl. No.: 14,056

[22] PCT Filed: May 6, 1986

[86] PCT No.: PCT/FI86/00046

§ 371 Date: Dec. 15, 1986

§ 102(e) Date: Dec. 15, 1986

[87] PCT Pub. No.: WO86/06662

PCT Pub. Date: Nov. 20, 1986

[30] Foreign Application Priority Data

May 7, 1985 [FI] Finland ..... 851790

[51] Int. Cl.[4] ..... B21J 15/20; B21J 15/26

[52] U.S. Cl. ..... 72/391; 72/453.16; 29/243.53

[58] Field of Search ..... 72/391, 114, 453.17, 72/453.16, 452; 29/243.53, 401.1, 560; 7/170

[56] References Cited

U.S. PATENT DOCUMENTS

| | | | |
|---|---|---|---|
| 2,455,903 | 12/1948 | Fischer | 72/391 |
| 2,965,258 | 12/1960 | Wilson et al. | 72/391 |
| 3,033,410 | 5/1962 | Hanneman | 72/391 |
| 3,127,045 | 3/1964 | Tschantz | 72/391 |
| 3,359,777 | 12/1967 | Lee | 72/391 |
| 3,374,656 | 3/1968 | Di Maio | 72/391 |
| 3,412,594 | 11/1968 | Lund | 72/391 |
| 3,423,986 | 1/1969 | Young | 72/391 |
| 3,534,581 | 10/1970 | Mullen | 72/391 |
| 3,626,745 | 12/1971 | Richardson et al. | 72/391 |
| 3,659,449 | 5/1972 | Abernathy | 72/391 |
| 3,822,595 | 7/1974 | Elflein | 72/391 |
| 3,906,775 | 9/1975 | Benimetzki | 72/391 |
| 4,263,801 | 4/1981 | Gregory | 72/391 |

*Primary Examiner*—David Jones

*Attorney, Agent, or Firm*—Dilworth & Barrese

[57] ABSTRACT

The present invention relates to a riveting apparatus for pop-rivets in particular. The riveting apparatus according to the invention is intended to be attached to a tool (1) provided with a rotatable shaft as an accessory thereof, preferably to a drilling machine, in such manner that the tool can preserve its original use. The riveting apparatus according to the invention comprises an eccentric (3) driven by the tool (1) and a hydraulic power unit (4) driven by the eccentric and supported by the tool, which power unit comprises a gripping mechanism for clamping the rivet shank and for the drawing and detachment thereof.

9 Claims, 3 Drawing Sheets

RIVETING APPARATUS

Figure 1:
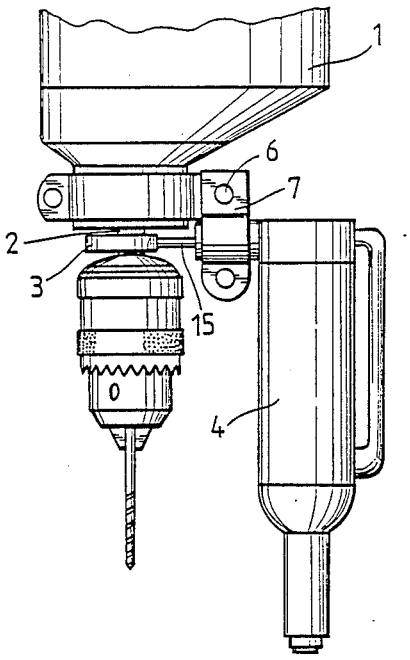

This invention relates to a riveting apparatus, for pop-rivets in particular, to be attached as an accessory to a tool provided with a rotatable shaft, preferably to a drilling machine, in such a manner that the tool preserves the original use thereof.

Previously known riveting appparatuses have been separate lever-operated tools designed specially for riveting.

A disadvantage of such previously known riveting apparatuses is that two separate tools are needed to carry out the riveting, i.e. a drilling machine for preparing a hole and a riveting apparatus for fixing the rivet in the hole. This, of course, is inconvenient and causes unnecessary stages in the work. Another disadvantage connected with previously known riveting apparatuses is that the wedge angle of the wedge-shaped gripping jaws which are manually clamped on the rivet shank is very small and the axial movement is long so that the apparatus could be operated with a reasonable force. Still another disadvantage is that the jaws very easily lock on the rivet shank after they have been drawn to the back position, and it is very difficult and time-consuming to remove the rivet shank from the riveting apparatus.

The object of the present invention is to eliminate the disadvantages of previously known riveting apparatuses and to provide a novel riveting apparatus by means of which the riveting can be carried out easily and rapidly.

This object is achieved according to the invention by means of a riveting apparatus of the type mentioned in the beginning, which apparatus is characterized in that the riveting apparatus is formed by an eccentric driven by the tool and a hydraulic power unit driven by the eccentric and supported by the tool, said power unit comprising gripping means driven by said unit for clamping a rivet shank and for the drawing and detaching thereof.

According to a preferred embodiment of the invention the power unit is supported by means of a supporting arm, whereby the power unit of the riveting apparatus serves as an additional handle for the tool when pivoted away from the working position.

The hydraulic power unit preferably comprises a first hydraulic driving means which is connected to the eccentric, and a second hydraulic means driven by a hydraulic fluid fed by the first hydraulic means.

With regard to the advantages of the invention, it is to be mentioned that the riveting apparatus according to the invention does not prevent the use of the tool for the original purpose thereof so that the riveting can be wholly carried out by using a drilling machine and the riveting apparatus according to the invention, which is attached thereto as an accessory. The invention is also advantageous in that the riveting apparatus is light to operate and the riveting can be carried out rapidly. Further, it is to be noted that in the riveting apparatus according to the invention the wedge angle of the gripping jaws which grip the rivet shank has been essentially increased, whereby the shorter axial movement enables the rivet shank to be gripped more rapidly; and that the drawing of the rivet shank as well as the detachment of a cut rivet shank is reliable.

Figure 3:
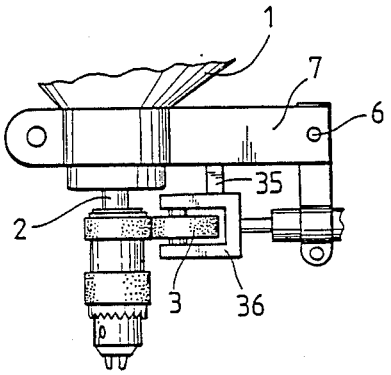
Figure 2:
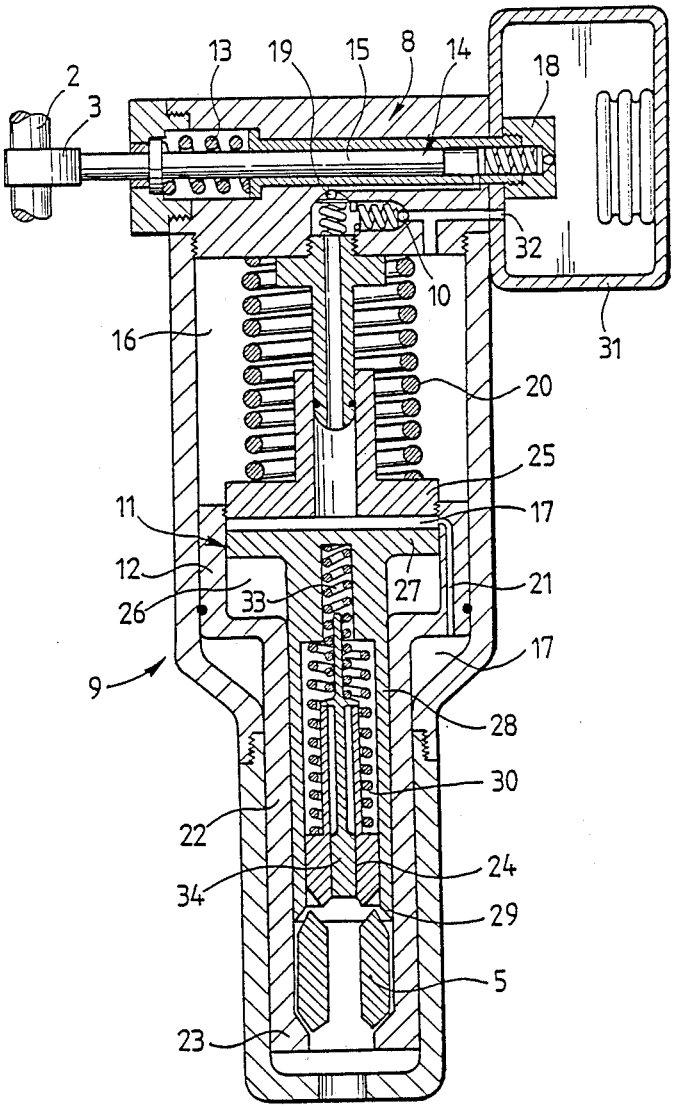
Figure 2B:
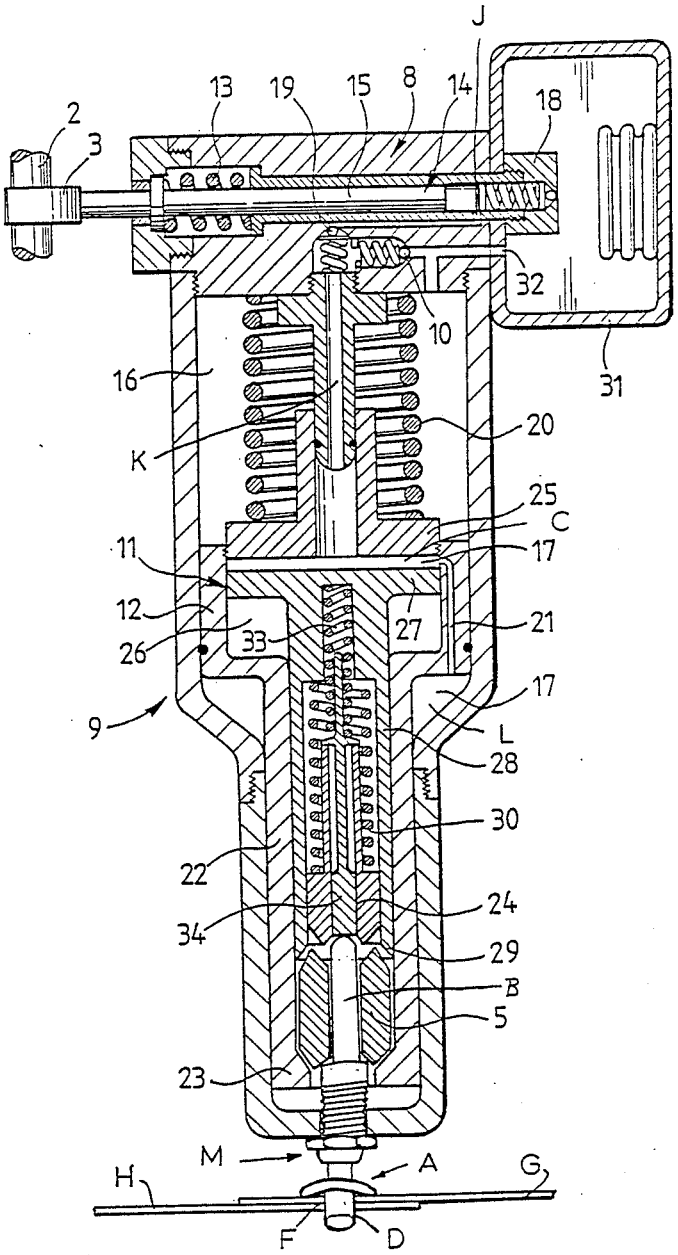

The invention will be described below by means of one preferred embodiment thereof with reference to the attached drawing, wherein FIG. 1 is a general view of a riveting apparatus according to the invention as attached to a drilling machine, FIG. 2 is a cross-sectional view of a hydraulic power unit of a riveting apparatus according to the preferred embodiment of the invention, and FIG. 2*b* is a further cross-sectional view of a hydraulic power unit of a riveting apparatus to the preferred embodiment of the invention and also depicting the operation of the apparatus, and FIG. 3 shows an alternative embodiment for the attachment of the riveting apparatus to a drilling machine.

In the embodiment according to FIG. 1 the riveting apparatus according to the invention is fastened to the fixing collar of the drilling machine by means of a supporting arm 7 provided with a joint 6; and an eccentric 3 supplying driving power to the riveting apparatus is mounted on a shaft 2 to rotate therewith between said fixing collar and the drill chuck. Alternatively, it is possible, as shown in FIG. 3, to support the eccentric on a projection 35 formed on the supporting arm 7 e.g. by means of a U-shaped suporting element 36, whereby it is advantageously supported on the drill chuck, thereby obtaining its driving power therefrom. In this embodiment the supporting element 36 is provided with a guide groove for the projection 35 to enable a back-and forth movement. In this way the drilling machine is maintained as a drilling machine, and it can still be used for its intended purpose. By the virtue of the jointed supporting arm attached to one end of the hydraulic power unit of the riveting apparatus, the riveting apparatus can be used as an additional handle for the drilling machine when pivoted aside from the working position.

FIG. 2 shows a cross-section of a hydraulic power unit 4 of the preferred embodiment of the invention. The hydraulic power unit according to this embodiment comprises; a first and a second hydraulic means 8 and 9, whereby said first hydraulic means 8 is arranged to drive said second hydraulic means 9 by means of a hydraulic fluid in order to move wedge-shaped gripping means 5 provided in the power unit 4 for gripping a rivet shank and for drawing thereof, and return means 10, 20, 24, 30 for displacing the gripping means to the initial position for the detachment of the rivet shank.

As appears from FIG. 2, said first hydraulic means is a piston pump 14, a piston rod 15 of which is loaded by a spring 13 and connected to the eccentric 3, which is mounted on the shaft 2. Said second hydraulic means 9 is a working cylinder 9 driven by the piston pump 14 and comprising a tank space 16 for the hydraulic fluid and a working space 17. The tank space 16 communicates with the working space of the piston pump during the suction stage of the piston pump, a back stroke valve 18 being provided in a conduit provided for the hydraulic fluid between the tank space 16 and the working space of the piston pump 14. The working space 17 in turn communicates with the working space of the piston pump during the pumping stage of the piston pump, whereby another back stroke valve 19 is provided in a conduit provided for the hydraulic fluid between the working space of the piston pump and the working space 17 of the working cylinder. The tank space 16 of the working cylinder is separated from the working space 17 thereof by means of a working piston 11 which is displaceable within the working cylinder and can be returned by means of a return spring 20. The piston rod 22 of the working piston 11 is hollow and the lower end thereof is provided with a conically tapering end portion 23 which is functionally connected with the lower end of the gripping means 5 fitted on the inside of the piston rod for the displacement of said means, the shape of the lower end of the gripping means corresponding to that of the lower end of the piston rod 22. Further, a return element 24 loaded by a spring 30 is fitted in the hollow inner space of the piston rod of the working piston for returning the gripping means 5 into the initial position thereof. The return movement of the gripping means is rapid so that a cut rivet shank is detached by the force of the return movement and can be easily passed into a suitable collecting container, for instance. Furthermore, a further returning element 34 loaded by another spring 33 is preferably provided on the inside of the return element 24 so as to ensure the detachment of a cut rivet shank. When a rivet is introduced into the riveting apparatus, said further returning element 34 is pushed inwards, and the spring 33 is activated. When the working piston 11 is returned into its initial position, said return element 34, which is retracted by the action of the spring 33, ensures that the rivet shank gets detached.

In the embodiment of FIG. 2, the working piston 11 is a cylindrical piston provided with a stationary cover portion 25. This cover portion separates the inner space 26 of the cylindrical piston from the tank space 16 of the working cylinder. As is apparent from the figure, a further piston member 27 is provided in the inner space 26 of the cylindrical piston, whereby the working space 17 of the working cylinder operates in two stages, the first stage taking place in the inner space of the cylindrical piston between the cover portion 25 and said further piston member 27, and the second stage outside of the cylindrical piston between the cylindrical piston 11 and an end piece closing one end of the working cylinder, where the above-mentioned gripping means 5, too, are positioned.

As further appears from FIG. 2, the cylindrical piston 11 and the piston rod 22 thereof form together a hollow body, within which said further piston member 27 is fitted concentrically. Said further piston member comprises a piston rod 28 provided with a hollow space and having one end open. The open lower end of the piston rod 28 of said further piston member has a conically enlarging part 29 which is pressed against the upper ends of the gripping means 5 having a corresponding shape by the action of the hydraulic fluid.

During the first stage of the working space the conically tapering part 23 of the cylindrical piston is pressed against the lower ends of the gripping means, and the conically enlarging part 29 of the further piston member 27 is pressed against the upper ends of the gripping means 5, whereby the gripping means are displaced inwards in the radial direction, thereby gripping the rivet shank. During the second stage of the working space the cylindrical piston 11 and the further piston 11 and the futher piston member 27 positioned therewithin are together displaced upwards and draw the rivet shank clamped between the gripping means 5 in the axial direction.

In order to combine the first and the second stage of the working space 17 into successive stages, a wall 12 of the cylindrical piston 11 is, in the present embodiment, provided with a conduit 21 for the hydraulic fluid, one end of which opens outside the cylindrical piston into the second stage of the working space, the other end opening into a space formed between the further piston member 27 displaceable within the cylindrical piston 11 and the cover portion 25 thereof at a distance from the upper dead point of said further piston member.

For the returning of the movable parts of the hydraulic power unit of the riveting apparatus according to the invention, i.e the gripping means 5 and the working piston 11, the hydraulic power unit comprises return means including a first return spring 20 fitted in the tank space 16 to act on the outer surface of the cover portion of the cylindrical piston; a second return spring 30, one end of which acts on the further piston member 27 and the other end on the return element 24, which in the present embodiment is mounted movably within the hollow piston rod 28 of the further piston member and the conically tapering end portion of which acts on the upper ends of the gripping means 5; and means 10 for releasing the pressure of the hydraulic fluid in the working space for enabling the downward movement of the working piston.

Said means 10 for releasing the pressure of the hydraulic fluid in the working space 17 can consist of e.g. a manually operated release valve which connects the working space with the tank space.

The hydraulic power unit according to the invention further comprises a pressure balancing chamber 31 which is attached to the tank space of the hydraulic fluid. This pressure balancing chamber is intended to observe any temperature rise in the hydraulic fluid and any decrease in the volume of the tank space 16 to keep the pressure of the hydraulic fluid on the suction side of the piston pump 14 at a constant value. As appears from FIG. 2, the pressure release valve 10 in this preferred embodiment opens into conduit 32 provided for the hydraulic fluid between the tank space 16 and the pressure balancing chamber 31.

In order to achieve a compact construction the piston pump 14, the back stroke valves 18, 19 and the pressure balancing chamber 31 as well as the pressure releasing means 10 and the conduit 32 provided with the hydraulic fluid between the pressure balancing chamber and the tank space 16 are positioned in the end piece which closes one end of the working cylinder and from which the entire hydraulic power unit is supported on the drilling machine 1. The back stroke valve 18 communicating with the tank space 16 for the hydraulic fluid is preferably directly attached to the working space of the piston pump, and the other back stroke valve 19 communicating with the working space 17 is attached thereto through a conduit. As further appears from FIG. 2, the stationarily positioned back stroke valve 19 is connected to the movable cover portion of the working piston telescopically by means of a projection intruding into the chuck in the cover portion of the working piston and provided with a conduit.

The following is a description of the operation of the apparatus of the present invention as evident from the preceding discussion and the drawings herein.

As the drilling machine 1 rotates, the eccentric 3 of the riveting apparatus produces a reciprocal movement of the piston rod 15 of the hydraulic means 8, said movement being due to the fact that the piston rod is loaded by the eccentric on the left-hand side and by the spring 13 of the hydraulic means 8 on the right-hand side, said spring keeping the piston rod perpetually pressed close against the eccentric (FIGS. 1 and 2). The arrangement illustrated in FIG. 3 corresponds to the arrangement of FIG. 1, except for the fact that the eccentric 3 is not fitted on the shaft 2 of the drilling machine but on the supporting element 36 sustained by the projection 25 of the supporting arm 7.

The course of the riveting is explained in detail in the following, with reference to FIGS. 2 and *2b*.

In FIGS. 2 and *2b*, the riveting apparatus is shown in its initial position. The equalizing chamber 31 of the apparatus shall naturally contain hydraulic fluid (oil) which serves as a power transmission fluid. Prior to the riveting, a nozzle means M of the known type is screwed onto the apparatus, into the aperture provided in the lower portion thereof. There is a separate nozzle for each rivet size. The nozzle means M will force the gripping means upwardly and open, whereafter the rivet A surrounded by the gripping jaws 5 can be pushed upwards, so that the end of the shank B of said rivet will force the return element 34 inwardly, thus biasing the spring 33. The gripping jaws 5 are pressed from above by a return element 24 biased by a spring 30, whereby the lower end of the return element 24 and the conically tapering end portion 23 guide the gripping jaws 5 into clamping engagement about the rivet shank B. The head D of the rivet is positioned in the bore F drilled in the plates G and H which are to be joined together. The drilling machine 1 is started, whereby the piston pump 14 starts to run. The piston pump will suck hydraulic fluid from the chamber 31 through a back stroke valve 18 into conduit J. The hydraulic fluid is forced via the conduit J to the back stroke valve 19 wherefrom the hydraulic fluid continues along conduit K via the hollow cylindrical working piston 25 into the working space 17 at a velocity directly proportional to the speed of rotation of the drilling machine 1 and the cylinder capacity of the piston pump 14. The space C (17) between the cover portion 25 of the working piston 11 and the second piston 27 is expanded on account of the pressure produced by the hydraulic fluid, and the enlarged portion 29 of the piston rod 28 starts to clamp the upper portion of the gripping jaws 5, thus enabling the gripping jaws 5 to grip firmly the rivet shank B. The hydraulic fluid moves further from the space C provided between the cover portion 25 and the second piston 27 via conduit 21 into the working space L (17). The pressure of the hydraulic fluid in the working space L will cause the working piston 11 to be raised upwards. As the piston pump 14 rotates, the working piston 11 will ascend and draw along therewith the gripping jaws 5 and the rivet A upwards, whereby the return spring 20 is simultaneously biased. When the rivet A is drawn at, the head D thereof is flattened, pressing therebetween the plates H and G which are to be joined together. The rivet A is continually drawn at until the shank B thereof is broken in the known manner, whereby a ready rivet is formed. When the shank B of the rivet is broken, the drilling machine 1 is stopped and the pressure release means 10 (back stroke valve) is guided e.g. by means of a lever (not shown, since the implementation of the opening of the valve is obvious to the man skilled in the art) to allow hydraulic fluid to re-enter the chamber 31. When the working space is depressurized, the return spring 20 pushes the working piston 11 downward and the hydraulic fluid will enter the tank space 16 and the chamber 31. As the pressure is released, the working space C between the cover portion 25 of the working piston 11 and the second piston 27 is reduced and the enlarged portion 29 of the piston rod 28 will no longer clamp the gripping jaws 5. Also, upon return of the working piston 11 to its lowermost position, the lower end of the return element 24 and conically tapering end portion 23 spread out the gripping jaws 5, whereby the grip of said gripping means 5 on the broken rivet shank is slackened and the ejector, i.e. the return element 34, is caused by the force of the spring 33 to press the broken river shank, whereby said shank is discharged from the riveting apparatus. Thereafter the apparatus is ready for a new rivet operation.

It should be noted that from the point of view of the operation of the apparatus the working piston 11 need not be of a dual type comprising a second piston 27, but the second piston may be totally omitted. However, the second piston 27 has the advantage of allowing the gripping means 5 to clamp the shank of the rivet with a relatively great additional force, apart from the normal clamping force that is inherent therein.

In FIG. 1, the riveting apparatus is shown in its operating position. When bores are made in the bodies to be joined together by a rivet by means of the drilling machine 1, the riveting apparatus is pivoted about the joint 6 into its lateral position, which makes it possible to use the drilling machine as an actual drilling machine.

The invention has been described above only with reference to one preferred embodiment thereof. The intention here has not, of course, been to restrict the invention, but it is possible to vary the riveting apparatus according to the invention in its details within the scope of the attached claims. So the working piston, for instance, does not need to be of the type described above, i.e. a cylindrical piston within which there is provided another piston member movable with respect thereto; instead, the working piston can be formed by one stationary working piston comprising a piston rod provided with a hollow space. A conduit for the hydraulic fluid thereby extends from the working space of the piston pump immediately below the working piston to a point between the working piston and the end piece closing one end of the working cylinder. Thereby the clamping of the gripping means and the drawing of the rivet shank are effected simultaneously. It is further to be noted that it is not necessary to place the piston pump at one end of the power unit, but it can also be fitted at the side of the working cylinder to reduce the length of the construction.

I claim:

1. A riveting apparatus, for pop-rivets in particular, powered by a conventional hand drill having a rotatable shaft, the apparatus comprising: a housing means for the attachment of the housing to said conventional hand drill; an eccentric associated with said attachment means and cooperating with the rotatable shaft of said hand drill and driving a hydraulic power unit located within the housing of the riveting apparatus, which hydraulic power unit comprises a first and second hydraulic means, the first hydraulic means including a hydraulic piston pump driven by the eccentric, said hydraulic piston pump driving said second hydraulic means of the apparatus by means of power-transmitting hydraulic fluid, said second hydraulic means comprising a movable working piston and spring, said working piston being returnable by means of said spring, said working piston having a hollow piston rod, the piston being completely enclosed by the housing of the hydraulic power unit independently of the position of said piston, said housing serving as a cylinder for said working piston, whereby gripping means for gripping, clamping and drawing a rivet shank and means for ejecting a cut rivet from the opening of the riveting apparatus and for returning said gripping means are fitted within said piston rod; a tank space for the power-transmitting hydraulic fluid, said tank space being disposed within said second hydraulic working cylinder and enclosing the spring which returns said working piston; a pressure balancing chamber attached to said housing; a conduit; a back stroke valve, and, said tank space being in communication via said conduit with said pressure balancing chamber in such a manner that said tank space is in communication with said hydraulic piston pump through said back stroke valve during the induction phase of said piston pump, said second hydraulic means being provided with a working space and a second back stroke valve, said working space being in communication with said hydraulic piston pump via said second back stroke valve during the pumping phase of said piston pump and which working space comprises a space below said working piston, which space upon filling with compressed hydraulic fluid raises said working piston upwards; and means for releasing the pressure of the hydraulic fluid in said working space.

2. A riveting apparatus according to claim 1, wherein said working space is in communication with the piston pump via a conduit passing through the working piston.

3. A riveting apparatus according to claim 1, wherein said means for the attachment of the housing to said conventional hand drill comprises a supporting arm provided with a joint, said supporting arm being fixed to a fastening collar of the hand drill and enabling said power unit to be pivoted to a lateral position.

4. A riveting apparatus according to claim 3, wherein said eccentric is mounted on the shaft on the hand drill for rotation therewith.

5. A riveting apparatus according to claim 3, wherein said eccentric is supported on a projection of said supporting arm by means of a U-shaped supporting element, whereby said eccentric is supported on said rotatable shaft of the hand drill.

6. A riveting apparatus according to claim 1, wherein said working piston is a cylindrical piston comprising a second piston means movable therewithin and a cover portion attached thereto and enclosing the second piston, said second piston means comprising a hollow piston rod the lower end thereof provided with a conically tapering end portion which clamps the gripping means about the rivet shank that is drawn while hydraulic fluid is pumped between said second piston means and said cover portion.

7. A riveting apparatus according to claim 6, wherein said spring returning the working piston is disposed within said tank space and acts upon said cover portion of the working piston, and the means for ejecting the cut rivet and returning said gripping means comprises a return spring acting at one end thereof upon the second piston means and at the other end thereof upon a return element movably mounted within the hollow piston rod of said second piston member, and the conically tapering lower end thereof acting upon the upper end of said gripping means.

8. A riveting apparatus according to claim 7, wherein a second return element is concentrically disposed within said return element for ejecting a cut rivet shank from between said gripping means, a separate return spring being provided for said second return element, said separate return spring being strained when a rivet is inserted in the riveting apparatus.

9. A riveting apparatus according to claim 1, wherein said means for releasing the pressure of the hydraulic fluid in said working space is a manually operated release valve communicating with said tank space and said pressure balancing chamber and being disposed within said conduit.

* * * * *